US007784967B2

(12) United States Patent
Lodhie

(10) Patent No.: US 7,784,967 B2
(45) Date of Patent: Aug. 31, 2010

(54) LOOP LED LIGHT

(76) Inventor: Pervaiz Lodhie, 12 Upper Blackwater Canyon Rd., Rolling Hills, CA (US) 90274

( * ) Notice: Subject to any disclaimer, the term of this patent is extended or adjusted under 35 U.S.C. 154(b) by 132 days.

(21) Appl. No.: 11/928,349

(22) Filed: Oct. 30, 2007

(65) Prior Publication Data

US 2009/0109676 A1 Apr. 30, 2009

(51) Int. Cl.
*F21V 21/00* (2006.01)

(52) U.S. Cl. ..... 362/249.06; 362/249.02; 362/249.14; 362/410

(58) Field of Classification Search ..... 362/216, 362/219, 217.02, 217.1, 217.12, 217.13, 362/217.14, 217.16, 217.17, 249.01, 249.02, 362/249.06, 249.14, 410, 414
See application file for complete search history.

(56) References Cited

U.S. PATENT DOCUMENTS

| | | | |
|---|---|---|---|
| 1,800,078 | A | 4/1931 | Johnson |
| 1,838,789 | A | 12/1931 | Schepperle |
| 2,260,473 | A | 10/1941 | Minchillo |
| 2,408,643 | A | 10/1946 | Hoy |
| D195,310 | S | 5/1963 | Zagel |
| 3,183,346 | A | 5/1965 | Spaulding et al. |
| 3,474,381 | A | 10/1969 | Baldwin |
| 3,539,801 | A | 11/1970 | Bobrick |
| 3,603,918 | A | 9/1971 | Woertz |
| 3,718,816 | A | 2/1973 | Seelbach et al. |
| 3,980,368 | A | 9/1976 | Fremont |
| 4,190,309 | A | 2/1980 | Glass |
| 4,211,955 | A | 7/1980 | Ray |
| 4,214,295 | A | 7/1980 | Morton |
| 4,217,018 | A | 8/1980 | Yoshida et al. |
| 4,655,520 | A | 4/1987 | Cummings |
| 4,727,289 | A | 2/1988 | Uchida |
| 4,729,742 | A | 3/1988 | Onishi et al. |
| 4,772,869 | A | 9/1988 | Grammas et al. |
| 4,812,814 | A | 3/1989 | Elliott |
| 4,868,719 | A | 9/1989 | Kouchi et al. |
| 4,907,361 | A | 3/1990 | Villard |
| 4,965,457 | A | 10/1990 | Wrobel |
| 5,055,984 | A | 10/1991 | Hung et al. |
| D326,532 | S | 5/1992 | Hume et al. |
| 5,119,174 | A | 6/1992 | Chen |
| 5,151,679 | A | 9/1992 | Dimmick |
| 5,152,601 | A | 10/1992 | Ferng |

(Continued)

OTHER PUBLICATIONS

Four (4) photographs of an LED light fixture that is commercially available.

(Continued)

*Primary Examiner*—Thomas M Sember
(74) *Attorney, Agent, or Firm*—Alonzo & Associates; Arlyn Alonzo

(57) ABSTRACT

A Light-Emitting Diode ("LED") light includes a ring-shaped housing wish a cross section, a transparent section and a non-transparent section. The ring-shaped housing defines a horizontal plane relative to a midpoint of the cross section, and a board is fitted within the ring-shaped housing at an angle between about ten to sixty degrees relative to the horizontal plane with LEDs mounted thereon the board to emit light through the transparent section. In one aspect, the board is a printed circuit board. In one aspect, the LEDs are mounted approximately perpendicularly onto the board.

25 Claims, 6 Drawing Sheets

U.S. PATENT DOCUMENTS 5,154,509 A 10/1992 Wulfman et al.
5,160,200 A 11/1992 Cheselske
5,160,201 A 11/1992 Wrobel
5,193,904 A 3/1993 Rist et al.
5,224,773 A 7/1993 Arimura
5,237,490 A 8/1993 Ferng
5,241,457 A 8/1993 Sasajima et al.
5,303,124 A 4/1994 Wrobel
5,353,209 A 10/1994 Foottit
5,390,092 A 2/1995 Lin
5,400,228 A 3/1995 Kao
5,410,453 A 4/1995 Ruskouski
5,453,729 A 9/1995 Chu
5,526,236 A 6/1996 Burnes et al.
5,567,036 A * 10/1996 Theobald et al. ..... 362/485
5,577,832 A 11/1996 Lodhie
5,580,163 A * 12/1996 Johnson, II ..... 362/285
5,585,783 A 12/1996 Hall
5,588,740 A 12/1996 Kasuga
5,599,086 A 2/1997 Dutta
5,629,607 A 5/1997 Callahan et al.
5,647,658 A 7/1997 Ziadi
5,661,374 A 8/1997 Cassidy et al.
5,661,645 A 8/1997 Hochstein
D385,051 S 10/1997 Wu
5,702,177 A 12/1997 Lin
D388,726 S 1/1998 Wu
5,710,560 A 1/1998 Cohn
5,765,940 A 6/1998 Levy et al.
5,772,315 A 6/1998 Shen
5,793,164 A 8/1998 Authier
5,803,585 A 9/1998 Littman et al.
5,806,965 A 9/1998 Deese
D402,772 S 12/1998 Lodhie
5,842,297 A 12/1998 Tung
D404,506 S 1/1999 Lodhie
5,855,268 A 1/1999 Zoladz, Jr.
D405,201 S 2/1999 Lodhie
5,887,968 A 3/1999 Logan
5,921,660 A 7/1999 Yu
5,929,788 A 7/1999 Vukosic
5,947,588 A 9/1999 Huang
5,964,051 A 10/1999 Loeber et al.
5,984,494 A 11/1999 Chapman et al.
6,011,493 A 1/2000 Bushell et al.
6,013,985 A 1/2000 Green et al.
D434,510 S 11/2000 Lodhie
6,152,568 A 11/2000 Baba et al.
6,220,722 B1 4/2001 Begemann
6,227,679 B1 5/2001 Zhang et al.
6,234,648 B1 5/2001 Borner et al.
6,283,612 B1 9/2001 Hunter
6,336,613 B1 1/2002 Roth
6,345,902 B2 2/2002 Ohkohdo et al.
6,371,636 B1 4/2002 Wesson
6,457,270 B1 10/2002 Stark, III et al.
6,457,410 B1 10/2002 Zerillo
6,550,949 B1 4/2003 Bauer et al.
6,580,228 B1 6/2003 Chen et al.
6,585,395 B2 * 7/2003 Luk ..... 362/249.02
6,598,996 B1 7/2003 Lodhie
6,659,622 B2 12/2003 Katogi et al.
6,659,623 B2 12/2003 Friend
6,659,632 B2 12/2003 Chen
6,700,502 B1 3/2004 Pederson
6,722,771 B1 4/2004 Stephens
6,768,047 B2 7/2004 Chang et al.
6,814,459 B2 11/2004 Pederson
6,908,214 B2 * 6/2005 Luk ..... 362/249.02
6,942,361 B1 9/2005 Kishimura et al.
7,063,451 B2 6/2006 Shen
7,111,957 B2 9/2006 Bernhart et al.
7,234,832 B2 6/2007 Lippis et al.
7,237,932 B2 7/2007 Ter-Hovhannissian
2002/0163805 A1 11/2002 Hubbell et al.
2002/0171543 A1 11/2002 Abbe et al.
2002/0196707 A1 12/2002 Kitchin et al.
2003/0095404 A1 5/2003 Becks et al.
2003/0102810 A1 6/2003 Cross et al.
2004/0012959 A1 1/2004 Robertson et al.
2004/0062041 A1 4/2004 Cross et al.
2006/0109661 A1 5/2006 Coushaine et al.

OTHER PUBLICATIONS

LED light fixtures available on the following website: www.hollysolar.com.
LED light fixtures available on the following website: www.geblighting.com.

* cited by examiner

LOOP LED LIGHT

FIELD

This disclosure relates generally to lighting sources. More particularly, the disclosure relates to a Light-Emitting Diode ("LED") light.

BACKGROUND

Historically, incandescent lights with filament-type bulbs have been a popular light source. Incandescent light bulbs illuminate radially outward and the illumination is distributed approximately uniformly in all directions. Fluorescent lights with fluorescent circular tubes have been an alternative to incandescent lights because of their energy-efficient qualities.

LED bulbs are light sources that use semiconductor materials rather than filaments or gasses to emit light. LED bulbs are generally more efficient light sources than incandescent, light bulbs because LED bulbs are nearly monochromatic and emit light within a very narrow range of wavelengths. LED bulbs also generally last many times longer than incandescent light bulbs or fluorescent light sources.

SUMMARY OF THE DISCLOSURE

According to one aspect, a Light-Emitting Diode ("LED") light comprising a ring-shaped homing having a cross section, a transparent section and a non-transparent section and wherein the ring-shaped housing defining a horizontal plane relative to a midpoint of the cross section; and a board fitted within the ring-shaped housing at an angle between about ten to sixty degrees relative to the horizontal plane and having a plurality of LEDs mounted thereon to emit, light through the transparent section.

According to another aspect, a Light-Emitting Diode ("LED") light comprising a ring-shaped housing having a cross section, a transparent section and a non-transparent section and wherein the ring-shaped housing defining a horizontal plane relative to a midpoint of the cross section; a support comprising at least one strut coupled to the non-transparent section; and a printed circuit board fitted within the ring-shaped housing at an angle between about ten to sixty degrees relative to the horizontal plane and having a plurality of LEDs mounted thereon to emit, light through the transparent section.

According to another aspect, a Light-Emitting Diode ("LED") light comprising a ring-shaped housing having a cross section, a transparent section and a non-transparent section and wherein the ring-shaped housing defining a horizontal plane relative to a midpoint of the cross section; a support comprising at least two struts coupled to the non-transparent section; and a printed circuit hoard fitted within the ring-shaped housing at an angle between about twenty to twenty-five degrees relative to the horizontal plane and having a plurality of LEDs mounted thereon, wherein the plurality of LEDs are mounted approximately perpendicularly onto the printed circuit board.

It is understood that other embodiments will become readily apparent to those skilled in the art from the following detailed description, wherein it is shown and described various embodiments by way of illustration. The drawings and detailed description are to be regarded as illustrative in nature and not as restrictive.

DETAILED DESCRIPTION

The detailed description set forth below in connection with the appended drawings is intended as a description of various embodiments of the present invention and is not intended to represent the only embodiments in which the present invention may be practiced. Each embodiment described in this disclosure is provided merely as an example or illustration of the present invention, and should not necessarily be construed as preferred or advantageous over other embodiments. The detailed description includes specific details for the purpose of providing a thorough understanding of the present invention. However, it will be apparent to those skilled in the art that the present invention may be practiced without these specific details. In some instances, well-known structures and devices are shown in block diagram form in order to avoid obscuring the concepts of the present invention. Acronyms and other descriptive terminology may be used merely for convenience and clarity and are not intended to limit the scope of the invention.

Figure 1:
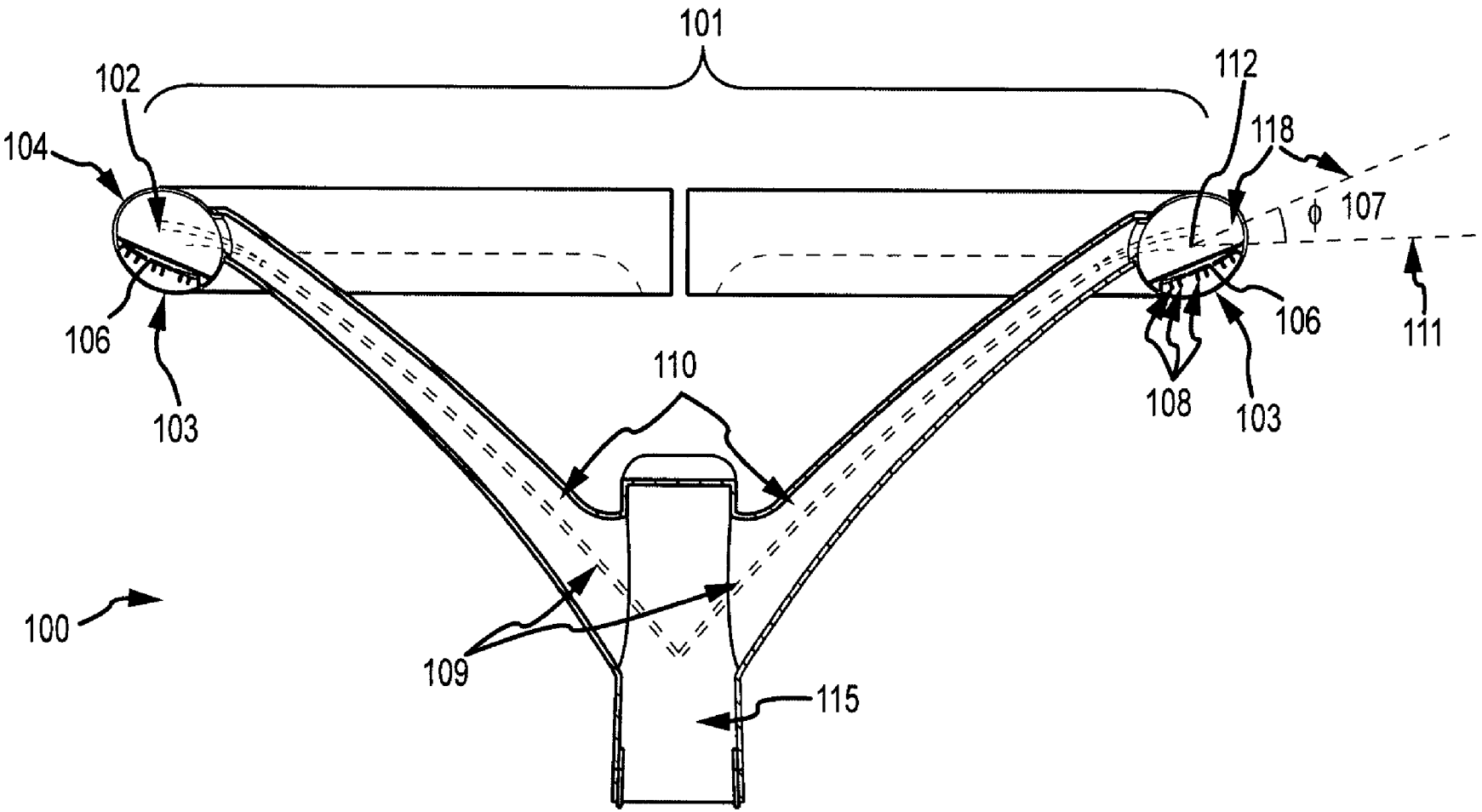
FIG. 1 is a cross-sectional view of an exemplary Loop LED light.

FIG. 1 is a cross-sectional view of an exemplary loop LED light 100 with a ring-shaped housing 101. In one aspect, a ring-shaped housing 101 includes an elliptical cross section 102. One skilled in the art would understand that the ring-shaped housing can take on a variety of cross sectional shapes, such as hut not limited to a circular cross section, without affecting the spirit for scope of the disclosure. In one aspect, the ring-shaped housing 101 includes a transparent, section 103 at the bottom portion and a non-transparent section 104 at the top portion to reduce light pollution above a particular horizontal line of sight. In one aspect, the non-transparent section 104 is semi-transparent to allow some light illumination directed towards the top portion of the loop LED light 100.

Figure 2:
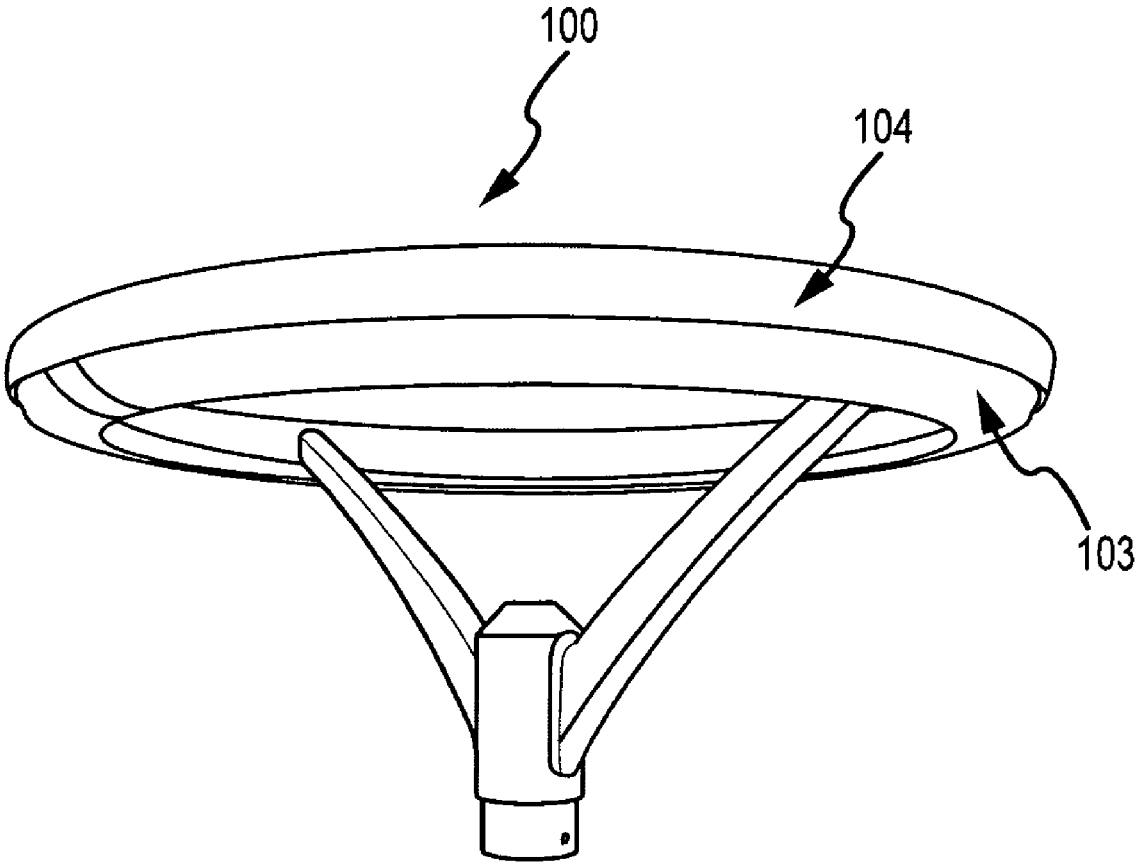
FIG. 2 shows a three-dimensional view of one example of the Loop LED light shown in FIG. 1.
Figure 3:
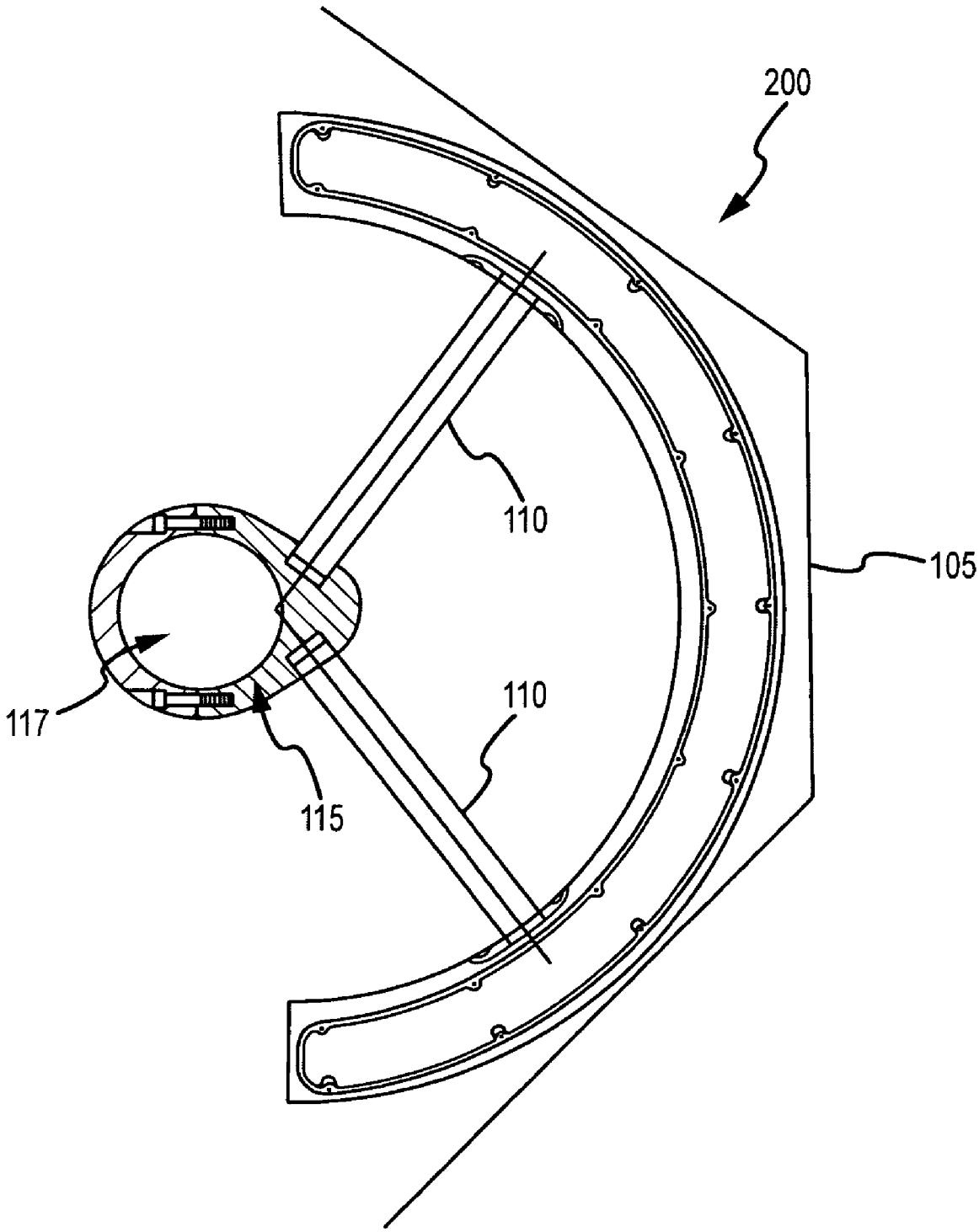
FIG. 3 shows the bottom view of one of the two halves 105 of the ring-shaped housing.

FIG. 2 shows a three-dimensional view of one example of the loop LED light shown in FIG. 1. In FIG. 2, the loop LED light includes a non-transparent section 104 at the top portion of the ring-shaped housing 101 and a transparent section 103 at the bottom portion, of the ring-shaped housing 101. The ring-shaped housing 101 can be made up of sections. For example, in one aspect, the ring-shaped housing 101 is made up of two halves 105. Each of the two halves includes an upper section and a lower section. In one aspect, the upper section includes a non-transparent section 104 and the lower section includes a transparent section 103. FIG. 3 shows the bottom view of one of the two halves 105 of the ring-shaped, housing 101. As shown in FIG. 3, the half 105 is attached to the support 115 through two struts 110.

In one aspect, a Printed Circuit Board ("PCB") 106 is fitted within the ring-shaped housing 101 at an angle 107. The angle 107 is denoted as ϕ in FIG. 1. The angle ϕ 107 is measured from a horizontal plane 111 through the midpoint 112 of the ring-shaped housing 101 to an axis 118 of the cross section. In the example shown in FIG. 1, the PCS 106 is fitted parallel to the axis 118. In one aspect, LEDs 108 are mounted approximately perpendicularly onto the PCB.

Figure 4:
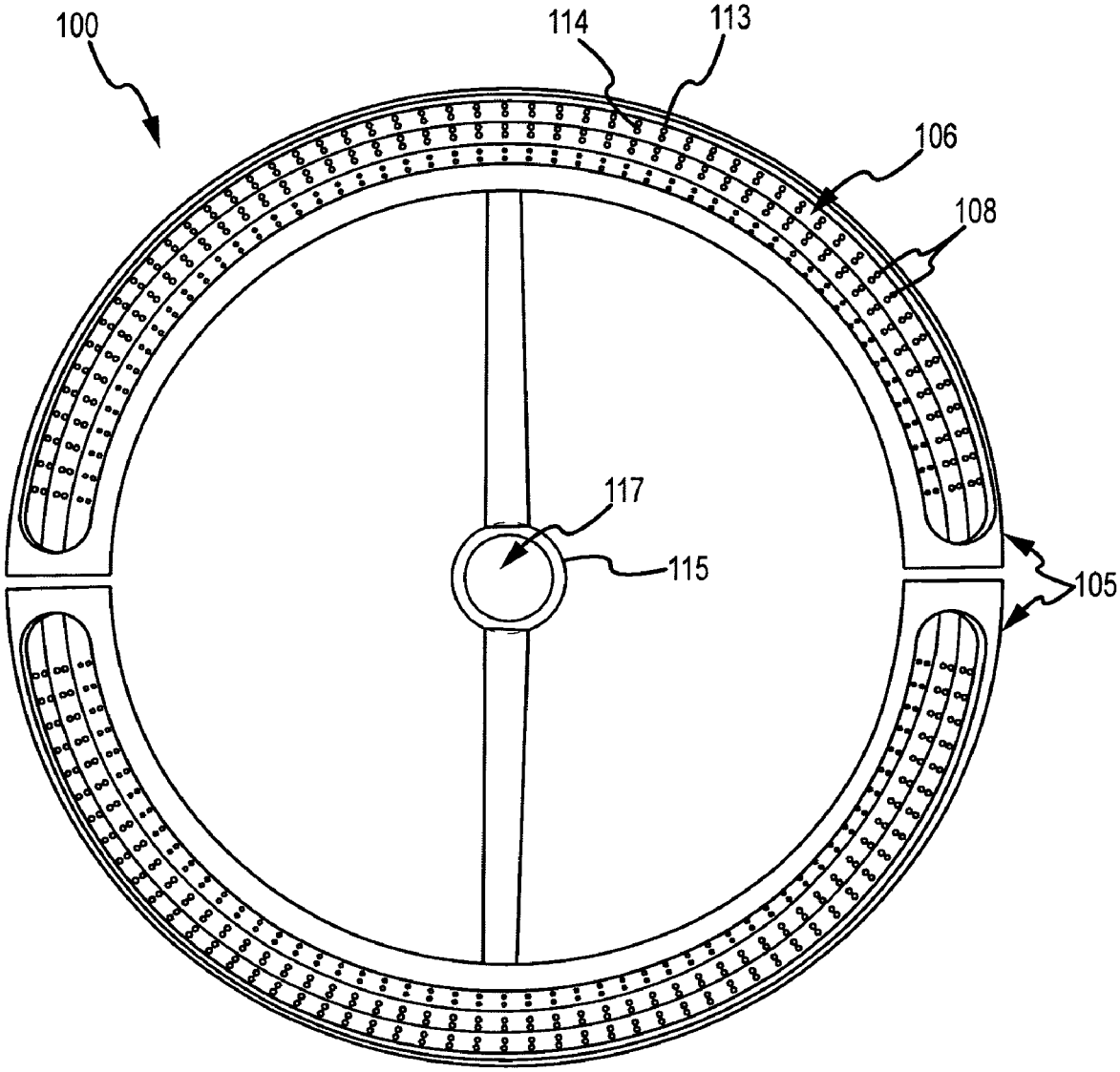
FIG. 4 shows the bottom view of a Printed Circuit Board (PCB) with LEDs mounted thereon.

FIG. 4 shows the bottom view of the PCS 106 with LEDs 108 mounted thereon. The PCB 106 provides electrical connectivity to the LEDs 108. The PCB 106 also provides physical support and orientation for the LEDs 108. In one aspect, the PCB 106 is sectioned into two PCB pieces to fit into the ring-shaped housing 101. Alternatively, the PCB 106 is-sectioned into other desired quantities to fit into the ring-shaped housing 101.

In one aspect, a board is fitted within the ring-shaped housing 101 at an angle 107, and the LEDs 108 are mounted approximately perpendicularly onto the board. The board provides physical support and orientation for the LEDs 108. The board may be sectioned into two or more board pieces to fit into the ring-shaped housing 101. Here, a PCB 106 is electrically coupled to the LEDs 108 to provide electrical connectivity to the LEDs 108. In one aspect, a PCB 106 may be located within the ring-shaped housing 101, for example, along side the board. In another aspect, a PCB 106 may be located external to the ring-shaped housing 101. For example, the PCB 106 may be located within the support 115. One skilled in the art would understand that the placement of the PCB 106 is a design choice and may depend on the particular application.

In one aspect, electrical wires 109 provide electrical connectivity between an external power supply (not shown) and the PCB 106. In one aspect, the electrical wires 109 are fed through the struts 110 and coupled to the PCB 106 which is fitted within the ring-shaped housing 101. One of ordinary skill would understand that the electrical and physical arrangement of the PCB 106 is a design choice that depends on a particular application.

In one aspect, the angle 107 is between ten and sixty degrees relative to a horizontal plane 111 through the midpoint 112 of the ring-shaped housing 101. As illustrated in FIG. 1, as an example, the angle 107 is approximately twenty to twenty-five degrees relative to the horizontal plane 111. In one example, the angle 107 is twenty-two degrees relative to the horizontal plane 111. In one aspect, the angle 107 is chosen to reduce illumination in directions that are parallel or near parallel to the horizontal plane 111 of the ring-shaped housing 101. Alternatively, the angle 107 is chosen to reduce illumination in directions that are lower than the horizontal plane 111. In one example, the angle 107 is chosen to result in an LED illumination pattern that would reduce illumination into the eyes of drivers approaching the loop LED light 100 in an oncoming direction.

In one aspect, the angle 107 at which the PCB 106 is fitted is chosen to reduce light pollution above an imaginary horizontal line of sight. Accordingly, the LEDs 108 are mounted approximately perpendicularly to the plane of the PCB 106 and emit light directed toward the ground to provide maximum desired ground illumination and to reduce light pollution above an imaginary horizontal line of sight. In one aspect the non-transparent section 104 is chosen to reduce light pollution above the imaginary horizontal line of sight. The non-transparent section 104 blocks light emitted from the LEDs 108.

In one aspect, the LEDs 108 are mounted on the PCB 106 in a column 113 and row 114 grid pattern. FIG. 4 is a bottom view of an exemplary LED light 100, illustrating the column 113 and row 114 grid pattern of the LEDs 108 on the PCB 106. The rows 114 of the LEDs 108 in FIG. 4 are arranged radially outward relative to the center of the ring-shaped housing 101. The columns 113 of the LEDs 108 in FIG. 4 are arranged in concentric circles relative to the center of the ring-shaped housing 101. The quantity of the LEDs 108 used in the LED light 100 is dependent on the particular application and desired illumination intensity. The arrangements of the LEDs 108 may include LEDs with narrow-beam angles or wide-beam angles. Alternatively, the LEDs 108 may also be composed of a combination of LEDs with narrow-beam angles and wide-beam angles designed to further spread out the light emitted from each of the LEDs 108. Generally, the narrower the LED beam angle, the further the emitted light may travel before losing its intensity. One skilled in the art would understand that the LED beam angle is a design parameter that is based upon the particular application and desired illumination pattern.

Figure 5:
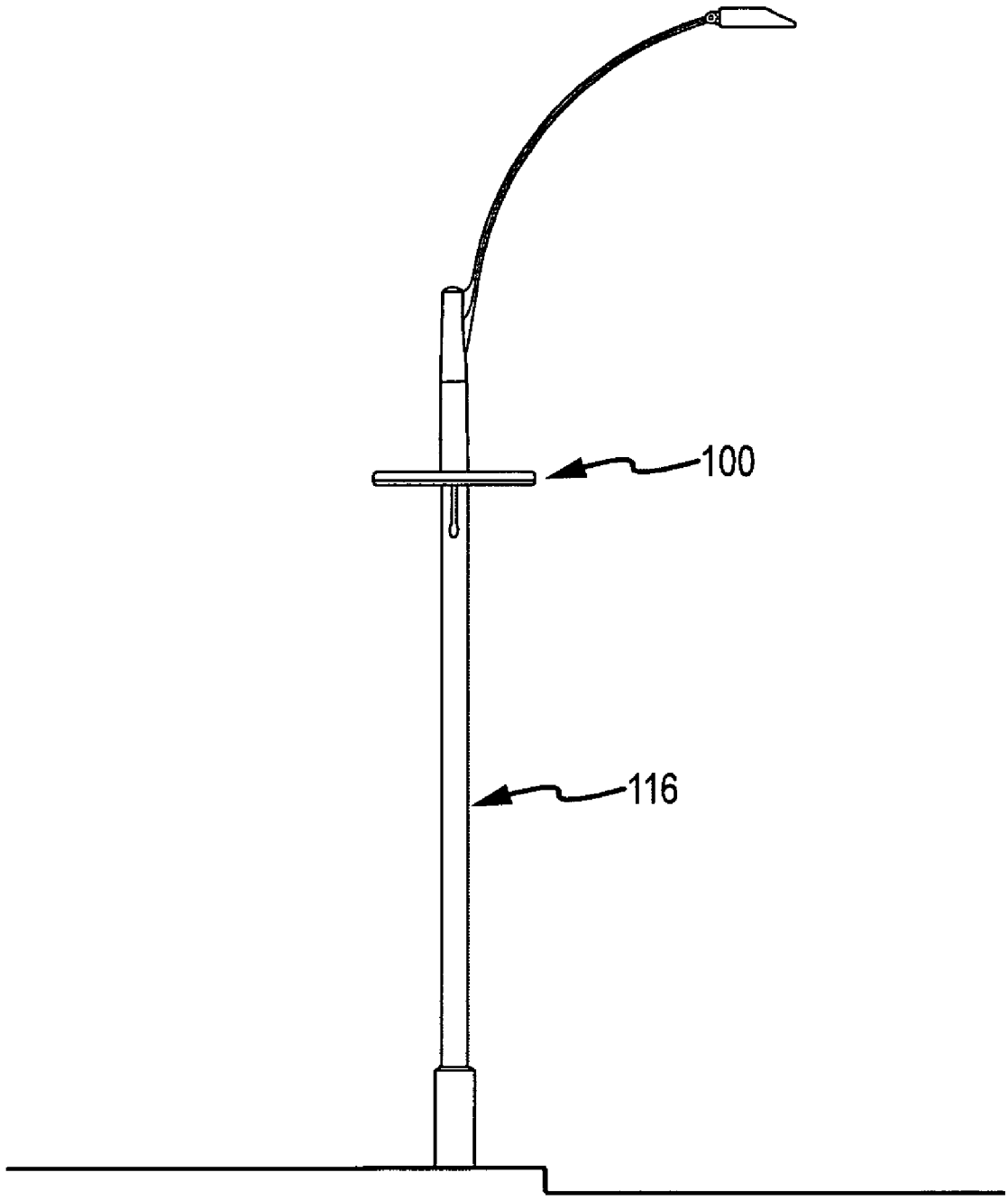
FIG. 5 is a side view the exemplary Loop LED light fixed to a post.
Figure 6:
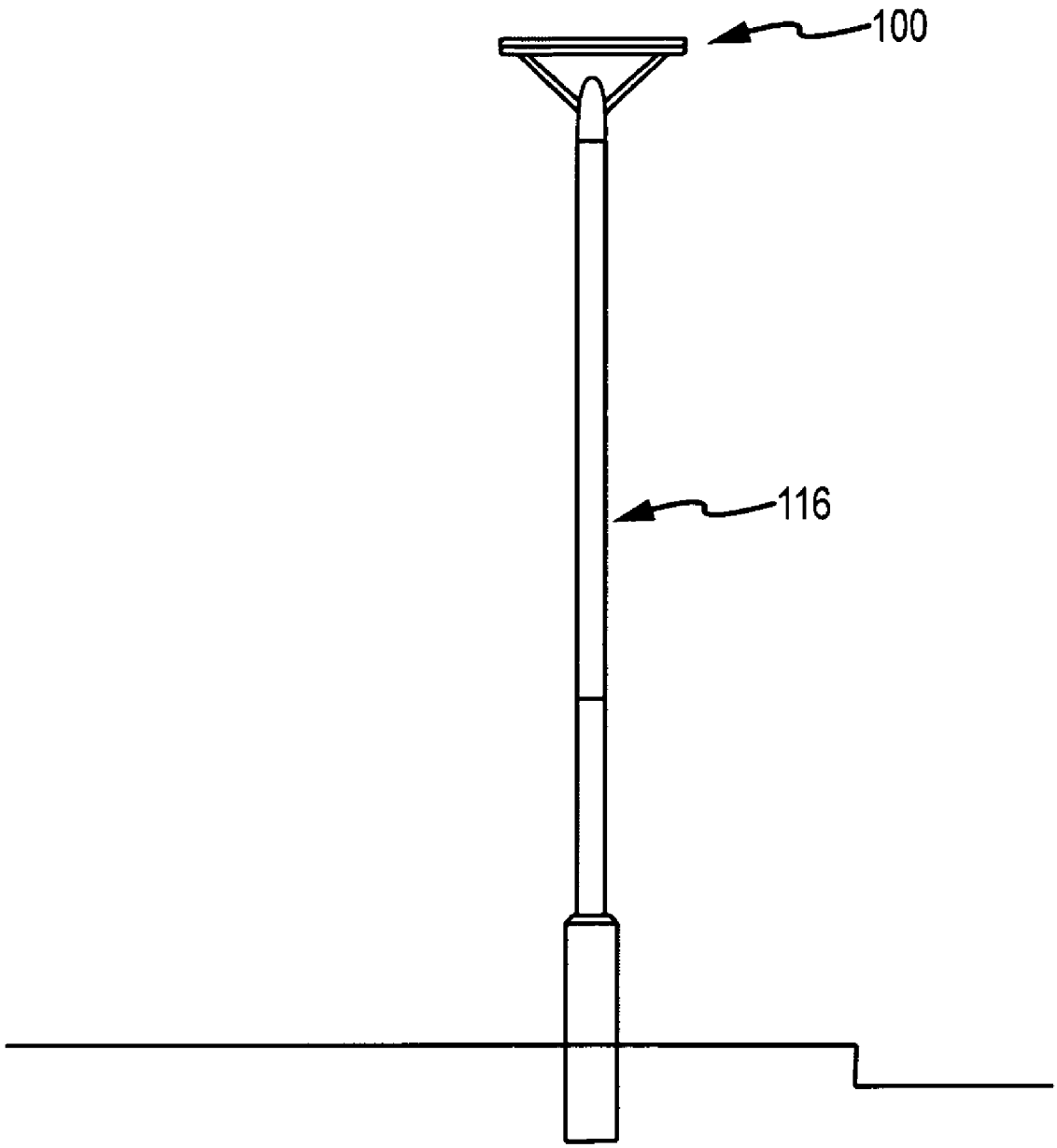
FIG. 6 is a side view an exemplary Loop LED light fixed to the top of a post.

An example of an application for the loop LED light 100 is to illuminate a street or sidewalk by mounting the loop LED light 100 on a street post as shown in FIGS. 5 and 6. One of ordinary skill in the art would recognize that the loop LED light 100 is not limited to the example of the street post, hot may be adapted to other various applications, including indoor illumination.

In one aspect, the transparent section 103 of the ring-shaped housing 101 is aligned with the angle 107. Accordingly, light emitted from the LEDs 108 passes through the transparent section 103 of the ring-shaped housing 101, and minimal illumination are directed towards the non-transparent section 104. FIG. 1 illustrates this alignment to show that the placement of the PCB 106, with the mounted LEDs 108, is aligned with the transparent section 103 to allow passage of light.

In one aspect, the loop LED light 100 includes at least one strut 110. FIG. 1, for example, shows two struts 110. However, the quantity of struts 110 may vary according to a particular application. One of ordinary skill would understand that the number of struts 110 is a design choice that depends on the application and various other factors such as but not limited to the weight of the loop LED light 100.

In one aspect, the struts 110 are coupled to a support 115 located approximately at the center of the ring-shaped housing 101. In one aspect, at least one strut 110 is fixed to the non-transparent section 104 of the ring-shaped housing 101. In one aspect, the electrical wires 109 are fed from the support 115 which houses a power supply (not shown) and then through the struts 110 to where the electrical wires 109 are coupled to the PCB 106 housed within the ring-shaped housing 101.

In one aspect, the support 115 is fitted to a post 116. For example, the support 115 may include an open center 117 (shown in FIG. 3) which fits around any height of the post 116. In one aspect FIG. 5 shows an exemplary loop LED light 100 at a height lower than the top of the post 116. Alternatively, the LED light 100 is fitted about the top end of the post as shown in FIG. 6.

The previous description of the disclosed embodiments is provided to enable any person skilled to the art to make or use the present invention. Various modifications to these embodiments will be readily apparent to those skilled in the art, and the generic principles defined herein may be applied to other embodiments without departing from the spirit or scope of the invention.

The invention claimed is:

1. A Light-Emitting Diode ("LED") light comprising:

a ring-shaped housing including an outer portion having a cross section, a transparent section and a non-transparent section and wherein the ring-shaped housing defining a horizontal plane relative to a midpoint of the cross section;

a board fitted within the ring-shaped housing at an angle between about ten to sixty degrees relative to the horizontal plane and having a plurality of LEDs mounted thereon to emit light through the transparent section; and wherein a hollow inner portion is located inside a boundary of the outer portion of the ring-shaped housing.

2. The LED light of claim 1, wherein the board is fitted parallel to an axis of the cross section.

3. The LED light of claim 1, wherein the cross section is elliptical.

4. The LED light of claim 1, wherein the cross section is circular.

5. The LED light of claim 1, wherein the ring-shaped housing is made of two halves with each of the two halves comprising an upper section and a lower section.

6. The LED light of claim 5, wherein the upper section includes the non-transparent section and the lower section includes the transparent section.

7. The LED light of claim 5, wherein the transparent section is aligned with the angle.

8. The LED light of claim 1, wherein the board is a printed circuit board.

9. The LED light of claim 1, wherein the board is a printed circuit board comprising of two or more PCB pieces.

10. The LED light of claim 1, wherein the board comprises two or more board pieces.

11. The LED light of claim 1, wherein the angle is between twenty degrees to twenty-five degrees.

12. The LED light of claim 11, wherein the LEDs are mounted approximately perpendicularly onto the board.

13. The LED light of claim 1, wherein the LEDs are mounted approximately perpendicularly onto the board.

14. The LED light of claim 13, wherein the LEDs include a combination of LEDs with narrow-beam angles and LEDs with wide-beam angles.

15. A Light-Emitting Diode ("LED") light comprising:

a ring-shaped housing including an outer portion having a cross section, a transparent section and a non-transparent section and wherein the ring-shaped housing defining a horizontal plane relative to a midpoint of the cross section, wherein a hollow inner portion is located inside a boundary of the outer portion of the ring-shaped housing;

a support comprising at least one strut coupled to the non-transparent section; and a printed circuit board fitted within the ring-shaped housing at an angle between about ten to sixty degrees relative to the horizontal plane and having a plurality of LEDs mounted thereon to emit light through the transparent section.

16. The LED light of claim 15, wherein the angle is between twenty degrees to twenty-five degrees.

17. The LED light of claim 15, wherein the printed circuit board is fitted parallel to an axis of the cross section.

18. The LED light of claim 15, wherein the ring-shaped housing is made of two halves with each of the two halves comprising an upper section and a lower section.

19. The LED light of claim 18, wherein the upper section includes the non-transparent section and the lower section includes the transparent section.

20. The LED light of claim 19, wherein the transparent section is aligned with the angle.

21. The LED light of claim 15, wherein the support is fitted to a post.

22. A Light-Emitting Diode ("LED") light comprising:

a ring-shaped housing including an outer portion having a cross section, a transparent section and a non-transparent section and wherein the ring-shaped housing defining a horizontal plane relative to a midpoint of the cross section, wherein a hollow inner portion is located inside a boundary of the outer portion of the ring-shaped housing;

a support comprising at least two struts coupled to the non-transparent section; and a printed circuit board fitted within the ring-shaped housing at an angle between about twenty to twenty-five degrees relative to the horizontal plane and having a plurality of LEDs mounted thereon, wherein the plurality of LEDs are mounted approximately perpendicularly onto the printed circuit board.

23. The LED light of claim 22, wherein the printed circuit board is fitted parallel to an axis of the cross section.

24. The LED light of claim 23, wherein the transparent section is aligned with the angle.

25. The LED light of claim 24, wherein the cross section is elliptical.

* * * * *